US005208921A

United States Patent [19]

Nicoll

[11] Patent Number: 5,208,921

[45] Date of Patent: May 11, 1993

[54] MAGNETIC DRAIN STOPPER

[76] Inventor: James D. Nicoll, 829 Randall, Troy, Mich. 48098

[21] Appl. No.: 820,199

[22] Filed: Jan. 13, 1992

[51] Int. Cl.[5] ..... E03C 1/23; E03C 1/26

[52] U.S. Cl. ..... 4/286; 4/287; 4/689

[58] Field of Search ..... 4/668, 678, 680, 681, 4/682, 683, 684, 685, 688, 689, 690, 691, 692, 693, 286, 287, 293, 295; 251/65

[56] References Cited

U.S. PATENT DOCUMENTS

| | | | |
|---|---|---|---|
| 1,980,250 | 11/1934 | Baxter | 4/690 |
| 2,289,574 | 7/1942 | Carlson | 251/65 |
| 2,346,904 | 4/1944 | Carlson | 251/65 |
| 2,454,333 | 11/1948 | Moon | 4/295 |
| 2,536,813 | 1/1951 | Jones et al. | 251/65 |
| 2,576,168 | 11/1951 | Allen | 251/65 |
| 3,125,764 | 3/1964 | Young | 4/692 |
| 3,348,543 | 10/1967 | Stafford | 128/214 |
| 3,652,054 | 3/1972 | Layton | 251/65 |

FOREIGN PATENT DOCUMENTS

| | | | |
|---|---|---|---|
| 1024046 | 3/1953 | France | 4/287 |
| 0525399 | 5/1955 | Italy | 4/295 |

*Primary Examiner*—William A. Cuchlinski, Jr.
*Assistant Examiner*—W. Morris Worth
*Attorney, Agent, or Firm*—Krass & Young

[57] ABSTRACT

A stopper assembly for a drain pipe includes a closure member having a stopper at one end and a cylindrical portion configured to fit into the drain pipe. An actuator disposed outside the drain pipe is magnetically coupled to the closure member and may be manipulated to raise and lower the closure member so as to open and close the drain outlet. The magnetic coupling avoids the need for any levers or other mechanical elements to pass through the wall of the drain pipe.

14 Claims, 1 Drawing Sheet

MAGNETIC DRAIN STOPPER

FIELD OF THE INVENTION

This invention relates generally to plumbing and more particularly to a stopper assembly for sinks, basins and tubs. Most specifically, the invention relates to a stopper assembly having magnetically coupled elements therein.

BACKGROUND OF THE INVENTION

It is common to close the drain openings of sinks, basins, tubs and the like with a stopper. In some instances, the stopper is a simple plug which is inserted into the drain opening. Stoppers of this type tend to become lost and require the user to reach into the tub to insert and remove them. As a consequence, drains are often provided with an automatically actuated stopper. Such prior art automatic stopper assemblies typically comprise an actuator linkage which is disposed in the drain pipe and which is operated by a lever passing through the pipe to raise and lower an attached stopper. Several problems arise with the use of this type of prior art stopper assembly. The linkage disposed in the pipe acts to trap hair, soap particles and the like so as to clog the drain. Such blockages are hard to clear and frequently require disassembly of the drain pipe. Additionally, the lever which passes through the drain pipe can be a source of leaks and makes installation and adjustment of the drain assembly difficult.

It would be highly desirable to have a drain stopper assembly which is readily installed and adjusted and which does not impose any obstructing hardware in the drain line. It is further desirable that any such drain stopper actuator be readily removable from the drain so as to permit easy cleaning of the drain pipe. The present invention provides an automatically actuated drain stopper assembly which includes magnetically coupled elements therein. The assembly of the present invention provides a clear drain path and does not require any levers or other hardware to pass through the drain pipe.

Magnetic actuators have heretofore been employed for purposes of fluid control; however, the use of a magnetic linkage for actuating an automatic drain assembly in the manner set forth hereinbelow has nowhere been shown or suggested in the prior art. U.S. Pat. No. 3,348,543 discloses the magnetic manipulation of a needle valve for purposes of controlling fluid flow in an intravenous solution delivery system. The control assembly of the '543 patent includes a ring-like magnet used for moving a tapered needle into and out of the body of the valve. This assembly cannot be utilized to seal a drain since hydrostatic pressure of water in the basin would tend to open the valve. Additionally, the opening provided thereby is relatively small and the nature of the valve would tend to cause clogging. U.S. Pat. No. 2,576,168 discloses a magnetic cut-off valve wherein movement of a ball by a magnet is employed to open and close a fluid flow path. U.S. Pat. Nos. 2,536,813; 2,346,904; and 2,289,574 all disclose valves including magnetic elements therein; however, none of these valves are adaptable to a sink assembly and none operate in the manner of the present invention.

BRIEF DESCRIPTION OF THE INVENTION

There is disclosed herein a stopper assembly configured to engage a drain pipe attached to a drain orifice of a sink. The stopper assembly is actuatable from a first position which closes the drain orifice to a second position which opens the drain orifice. The stopper assembly includes a closure member having a hollow cylinder configured to pass through the drain orifice and into the drain pipe. The hollow cylinder defines a central passageway therethrough and a first length of the cylinder is made of a first magnetic material. The closure member also includes a stopper which is larger than the drain orifice and which is disposed at one end of the cylinder. The stopper assembly also includes an actuator which has a body of a second magnetic material disposed to surround a portion of the length of the exterior of the drain pipe. At least one of the first magnetic material and the second magnetic material is a permanent magnet and magnetic coupling between the closure member and the actuator is thereby achieved. The hollow cylinder may include an opening therethrough proximate the stopper. In particular embodiments the opening in the cylinder is configured as a plurality of slits which extend therethrough. The slits commence proximate the stopper and run for at least a portion of the length of the cylinder. In one particular embodiment the slits run the entire length of the cylinder.

In another embodiment of the invention, the cylinder includes a second length comprised of a non-magnetic material which is disposed proximate the stopper. In yet another embodiment, the magnetic material of the actuator comprises a neodymium containing permanent magnet. And in particular applications the actuator may include a rod associated therewith for moving the actuator from a first position to a second position for opening and closing the drain.

DETAILED DESCRIPTION OF THE INVENTION

Figure 1:
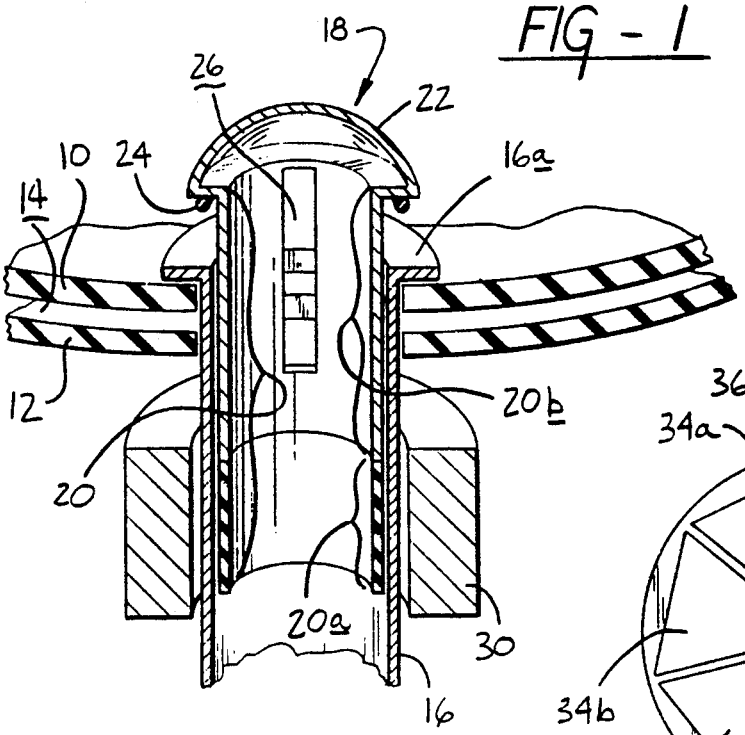
FIG. 1 is a cross-sectional view of a portion of a sink showing the stopper assembly of the present invention employed therewith.

One embodiment of stopper assembly structured in accord with the principles of the present invention is illustrated, in cross section, in FIG. 1. Shown is a portion of a sink specifically including two walls 10,12 in spaced apart relationship. The inner wall 10 forms the interior, water-retaining portion of the sink and the outer wall 12, the outside of the sink. The space therebetween 14 is in communication with an overflow drain (not shown). Such construction is well known to those of skill in the art. The sink further includes a drain pipe 16 which typically includes a flange **16*a* which engages the interior wall 10** of the sink to provide a drain orifice.

The stopper assembly of the present invention includes a closure member 18 which includes a cylindrical portion 20 sized to fit closely into the drain line 16. As will be explained in greater detail hereinbelow, the cylindrical portion includes a first length thereof **20*a*** fabricated from a first magnetic material and a second length 20*b* fabricated from a non-magnetic material. The closure member includes a stopper 22 disposed at one end of the hollow cylinder 20. The stopper 22 is sized so as to prevent its passage into the drain pipe 16. The stopper further includes a sealing gasket 24 associated therewith for engaging the flange 16*a* of the drain pipe 16. It will also be noted that the closure member 18 includes an opening 26 therethrough proximate the stopper 22. This opening is, in this embodiment, configured as a slit and when the closure member is in the elevated position, as illustrated in the figure, the opening 26 allows water to pass through the wall of the cylinder 20 and into the drain pipe 16. As noted hereinabove, the sink includes an interior space 14 communicating with the overflow drain, and the slit 26 is sufficiently large so that when the stopper is in the lowered or closed position the slit still establishes communication between the interior space 14 and the drain pipe 26 so as to prevent accidents resultant from overfilling of the sink.

The stopper assembly further includes an actuator 30 which surrounds at least a portion of the length of the cylindrical member contained within the drain pipe 16. The actuator 30 includes a body of a second magnetic material. In the most preferred embodiment, the actuator 30 includes a permanent magnetic material and the first magnetic material which comprises a first length 20*a* of the hollow cylinder 20 is a ferro magnetic material and in this manner, magnetic coupling between the actuator 3 and the closure member 18 is effected. Although not illustrated in this figure, the actuator 30 includes a rod or similar member associated therewith. The rod projects from the top of the sink and is operative to move the actuator in an upward and downward direction and such motion of the actuator 30 causes a corresponding motion of the closure member 18.

It is to be noted that in the illustrated embodiment, the magnetic body 30 of the actuator is of a greater length than the length of the magnetic portion 20*a* of the cylinder 20. By employing an arrangement of this type, the magnetic portion 20*a* of the cylinder will center itself within the magnetic field created by the actuator 30 thereby simplifying adjustment of the assembly. It is also to be noted that the cylinder 20 of the closure member is relatively close in diameter to the diameter of the drain pipe 16 and provides a relatively close clearance. Such close geometry allows the drain pipe 16 to guide the closure member 18 therethrough. In use, the magnet of the actuator 30 will draw the cylinder 20 of the closure member into contact with the drain pipe 16. This frictional contact assists in retaining the closure member 18 in the drain pipe 16. Should the diameter of the cylindrical portion 20 of the closure member 18 be significantly smaller than the diameter of the drain pipe 16, proper seating of the stopper may be prevented since the cylinder portion 20 of the closure member 18 will be drawn against the drain pipe 16 at a rather large angle.

It is further to be noted that the non-magnetic portion 20*b* of the cylinder 20 is most proximate the stopper portion 22 of the closure member 18. This physical configuration of the magnetic and non-magnetic portions enables the closure member to readily center within the field of the actuator's magnet, thereby permitting smooth and positive motion of the stopper 22 in response to upward and downward motion of the actuator 30.

The magnet of the actuator 30 may comprise a single large cylindrical magnet surrounding the drain pipe 16 or it may be comprised of a plurality of smaller magnets disposed in a matrix.

Figure 2:
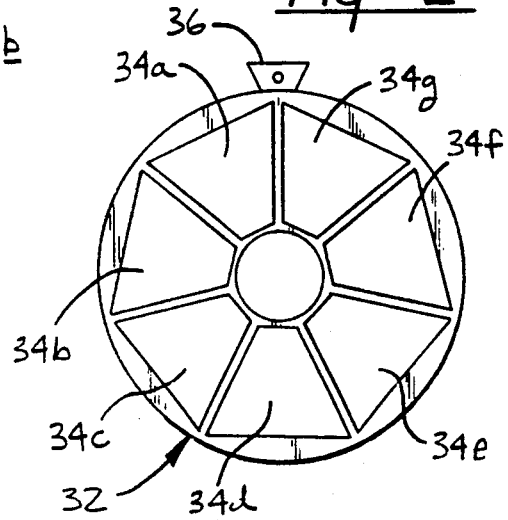
FIG. 2 is a top plan view of one embodiment of actuator structured in accord with the principles of the present invention.

Referring now to FIG. 2 there is shown a top plan view of another embodiment of actuator 32 which includes a plurality of discrete magnets 34*a*–34*g*. It is also noted, the actuator 30 includes an attachment clip 36 for engaging a rod.

Figure 3:
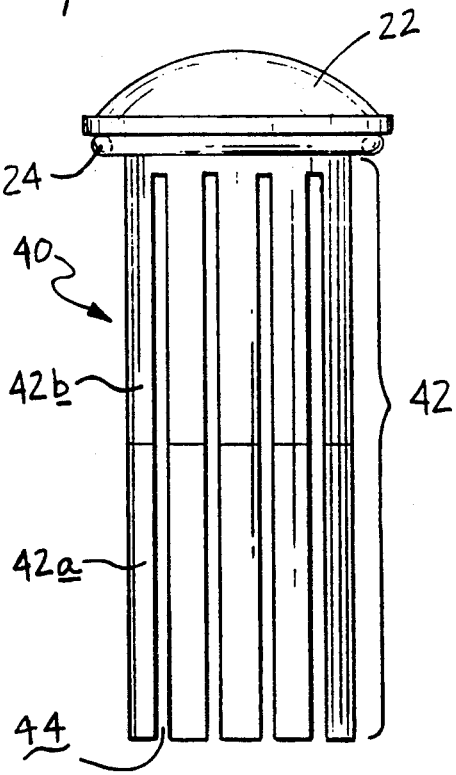
FIG. 3 is a front elevational view of one embodiment of closure member structured in accord with the principles of the present invention.

There are a variety of configurations in which the components of the present invention may be manufactured. FIG. 3 depicts another embodiment of closure member 40. The closure member 40 of FIG. 3 includes a cylindrical portion 42 which has a first region 42*a* which is magnetic and a second region 42*b* which is non-magnetic.

The closure member 40 further includes a stopper 22 as previously described and having a gasket 24 associated therewith. The closure member 40 of FIG. 3 includes a plurality of slits 44 which extend substantially the entire length of the cylindrical portion 42. These slits 44 are open at the bottom and thus eliminate the potential of clogging by fibers or soap residue. Additionally, it has been found that the lengthwise slits act as cutters and mere rotation of the closure member 40 in the drain pipe will serve to clean any residue from either the pipe or the closure member 40. Clearly, other configurations of closure member may be employed in the practice of the present invention.

Figure 4:
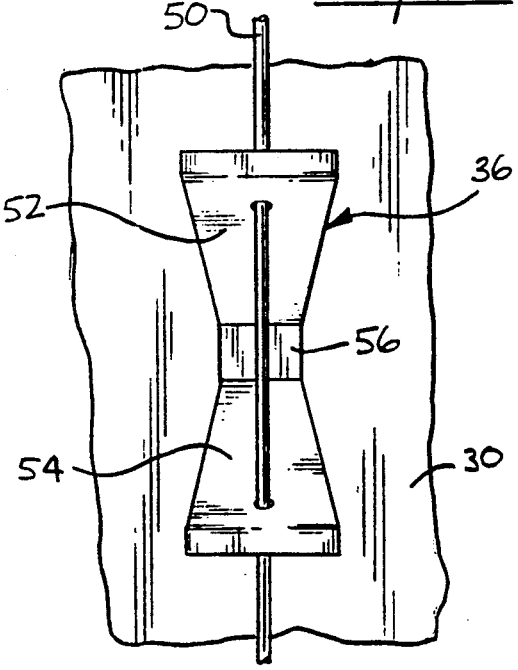
FIG. 4 is a front elevational view of a portion of an actuator illustrating the attachment of an actuator rod thereto.

Referring now to FIG. 4 there is shown a portion of an actuator member 30 having an attachment clip 36 affixed thereto for slidably retaining an actuator rod 50. The clip 36 is fabricated from a resilient material such as spring steel and the illustrated configuration includes two separate tab portions 52,54 which are affixed to the actuator 30 via a central portion 56. Attachment may be through a spot weld, solder, adhesive or a mechanical affixation such as a screw, tab and slot arrangement or the like. The two tabs 52,54 each have a hole therethrough configured to receive the rod 50. Through the use of the clip 36, the rod 50 and actuator 30 may be positionally adjusted relative to one another by simply squeezing the tabs 52 54 together slightly so as to release the grip on the rod 50 and by repositioning the rod and actuator 30 relative to one another. Releasing of the tabs 52,54 causes the clip 36 to grip the rod 50. Clearly, other fixturing arrangements such as a set screw and the like may be similarly employed.

There are a variety of materials which may be employed to fabricate the stopper assembly of the present invention. With reference to FIG. 1, it is to be understand that the first magnetic material 20*a* of the cylinder 20 is preferably a ferro magnetic material such as an iron-based alloy. One particularly preferred material is magnetic stainless steel of the type which is commercially available under the designation 400 stainless steel. This material combines magnetic attractability with corrosion resistance and is generally preferred for the magnetic portion of the closure member although other magnetically attractable alloys as well as galvanized steel and other coated materials may be similarly employed. The non-magnetic portion of the cylinder is preferably fabricated from a metal such as brass or a non-magnetic alloy such as 300 type stainless steel. In some instances, the non-magnetic portion of the cylinder may be fabricated from polymeric material. In other instances, the nonmagnetic portion may be simply eliminated and the entire length of the cylinder may be magnetic.

The stopper portion of the closure member is most preferably fabricated from the same material as the non-magnetic portion 20*b* of the cylinder 20 although it is to be understood that various other materials, including magnetically attractable materials, may be employed to fabricate the stopper portion 22 of the closure member 18. The actuator 30 is preferably fabricated from a permanent magnetic material and one particularly preferred magnetic material is a neodymium-based magnetic alloy. Other preferred magnetic alloys comprise samarium-cobalt alloys and the like. In general, any magnet having a high degree of magnetic strength and a high degree of permanence may be employed. In this regard, the commonly available ceramic magnets have also been found to be satisfactory. As noted above, the magnetic portion of the actuator 30 may comprise a single large magnet or may comprise a plurality of individual magnets. Generally, the magnets are encased in a protective material such as body of polymer or a non-magnetic metal such as aluminum. In the vast majority of drain installations the sink drain pipe is fabricated from plated brass or polymeric material and hence will not interfere with the magnetic action of the stopper assembly of the present invention.

It will be appreciated that the stopper assembly of the present invention may be fabricated in configurations other than those precisely shown herein depending upon the particular geometry of the sink or tub and drain involved. Likewise, aesthetic considerations may dictate the shape and finish of the stopper portion. While the assembly has been described primarily in terms of the actuator comprising a permanent magnet and the cylinder as including a ferro magnetic portion it will be appreciated that these materials may be reversed and the permanent magnet may be associated with the cylinder and the magnetically attractable body may comprise the actuator. Similarly, both the actuator and cylinder may have permanent magnets associated therewith. For this reason, the ferro magnetic material and the permanent magnet are both referred to herein as "magnetic materials," this term being understood to include any material which is, or is attracted by, a magnet.

In view of the foregoing it will be appreciated that the present invention may be practiced in a variety of embodiments. The foregoing drawings, discussion and description are meant to illustrate particular embodiments of the present invention but are not meant to be limitations upon the practice thereof. It is the following claims, including all equivalents, which define the scope of the invention.

I claim:

1. A stopper assembly configured to engage a drain pipe attached to a drain orifice of a sink, said stopper assembly being actuatable from a first position which closes the drain orifice to a second position which opens the drain orifice, said assembly comprising:

a closure member having:

a hollow cylinder configured to pass through the drain orifice and into the drain pipe and defining a central passageway therethrough, a first length of the cylinder comprising a first magnetic material; and a stopper disposed at one end of said cylinder and being of a size larger than the size of the orifice; and stopper assembly further including:

an actuator including a body of a second magnetic material disposed to surround a length of the exterior of the drain pipe;

wherein at least one of said first magnetic material and said second magnetic material comprises a permanent magnet so that magnetic coupling between the closure member and the actuator is achieved;

said stopper assembly further including a rod associated with the actuator for moving the actuator and the closure member which is magnetically coupled thereto from said first position in which the stopper assembly closes the drain orifice to said second position in which the stopper assembly opens the drain orifice.

2. A stopper assembly as in claim 1, wherein the hollow cylinder includes an opening therethrough proximate the stopper, said opening communicating with the central passageway.

3. A stopper assembly as in claim 1, wherein the cylinder includes a plurality of elite therethrough, said elite commencing proximate the stopper and running along at least a portion of the length of the cylinder, said slits communicating with the central passageway.

4. A stopper assembly as in claim 3, wherein said slits run the entire length of the cylinder.

5. A stopper assembly as in claim 1, wherein said stopper includes a sealing gasket associated therewith.

6. A stopper assembly as in claim 1, wherein a second length of the cylinder comprises a non-magnetic material.

7. A stopper assembly as in claim 6, wherein the length of the cylinder comprising a non-magnetic material is disposed proximate the stopper.

8. A stopper assembly as in claim 1, wherein the first magnetic material is a ferromagnetic material.

9. A stopper assembly as in claim 1, wherein the second magnetic material is a permanent magnet.

10. A stopper assembly as in claim 9, wherein said permanent magnet is a neodymium containing magnet.

11. A stopper assembly as in claim 9, wherein the body of second magnetic material comprises a plurality of permanent magnets.

12. A stopper assembly as in claim 1, wherein the body of a second magnetic material has a length which is greater than the first length of the cylinder.

13. A stopper assembly configured to engage a drain pipe attached to a drain orifice of a sink, said stopper assembly being actuatable from a first position which closes the drain orifice to a second position which opens the drain orifice, said assembly comprising:

a hollow cylinder configured to pass through the drain orifice and into the drain pipe and defining a central passageway therethrough, a first length of the cylinder comprising a first magnetic material and a second length of the cylinder comprising a non-magnetic material, said second length extending to one end of the cylinder and including an opening therethrough, proximate said end communicating with the central passageway;

a stopper disposed at one end of the cylinder, said stopper being of a size larger than the size of the drain orifice and operative to seal the drain orifice when the assembly is actuated to said first position; and an actuator which includes a body of permanent magnetic material disposed to create a magnetic field which surrounds a length of the exterior of the drain pipe so as to magnetically couple the actuator and the cylinder, said actuator further including a rod associated therewith for moving the body of permanent magnetic material between a first position along the length of the drain pipe to a second position along the length of the drain pipe.

14. A stopper assembly as in claim 13, wherein the length of the body of permanent magnetic material is greater than the first length of the cylinder.

* * * * *